US005905242A

United States Patent [19]

Bernard et al.

[11] Patent Number: 5,905,242

[45] Date of Patent: May 18, 1999

[54] HIGH VOLTAGE HYBRID CIRCUIT-BREAKER

[75] Inventors: Georges Bernard, Saint-Egreve; Pierre Chevrier, Grenoble; Jean-Claude Faye, Seyssinet; Pierre Leclercq, Moirans; Joseph Maftoul, Corenc, all of France

[73] Assignee: Schneider Electric SA, France

[21] Appl. No.: 09/011,621

[22] PCT Filed: Jul. 30, 1996

[86] PCT No.: PCT/FR96/01197

§ 371 Date: Feb. 12, 1998

§ 102(e) Date: Feb. 12, 1998

[87] PCT Pub. No.: WO97/08723

PCT Pub. Date: Mar. 6, 1997

[30] Foreign Application Priority Data

Aug. 31, 1995 [FR] France ..... 95 10326

[51] Int. Cl.[6] ..... H01H 33/12; H01H 33/66; H01H 9/38

[52] U.S. Cl. ..... 218/16; 218/7; 218/78; 218/154

[58] Field of Search ..... 218/1, 2, 3, 4–7, 218/8, 9, 11, 14, 16, 19, 20, 21, 44, 59, 68, 69, 70, 72, 73, 78, 84, 154, 155, 156

[56] References Cited

U.S. PATENT DOCUMENTS 3,571,543 3/1971 Perkins et al. .
3,671,696 6/1972 Brunner .
4,087,664 5/1978 Weston .
4,458,119 7/1984 Hashimoto et al. .
4,538,039 8/1985 Gotoh et al. ..... 218/16
4,550,234 10/1985 Stenemer ..... 218/14
5,079,392 1/1992 Tsukushi et al. ..... 218/7
5,155,315 10/1992 Malkin et al. ..... 218/14

FOREIGN PATENT DOCUMENTS 4405206 8/1995 Germany .

*Primary Examiner*—Lincoln Donovan
*Attorney, Agent, or Firm*—Parkhurst & Wendel

[57] ABSTRACT

A high voltage hybrid circuit-breaker has an arc circuit with a gas circuit-breaker connected in a series with a vacuum bulb. The housing is subdivided into a first compartment enclosed by an insulator for housing the primary contacts of the primary circuit and of the gas circuitbreaker and a second adjacent compartment (14) containing the vacuum bulb, defined by a conductive metallic shell. The movable arcing contact of the gas circuit-breaker is actuated with the movable primary contact by a primary control rod connected to a common mechanism, wherein the displacement of the movable arcing contact of the vacuum bulb is derived from the translational movement of the primary rod through an intermediate transmission lever received in the second compartment.

3 Claims, 2 Drawing Sheets

$I_T$ = TOTAL CURRENT
$I_P$ = MAIN CONTACTS CURRENT
$I_D$ = CIRCUIT BREAKERS CURRENT
$U_G$ = GAS CIRCUIT BREAKER VOLTAGE
$U_V$ = VACUUM CIRCUIT BREAKER VOLTAGE
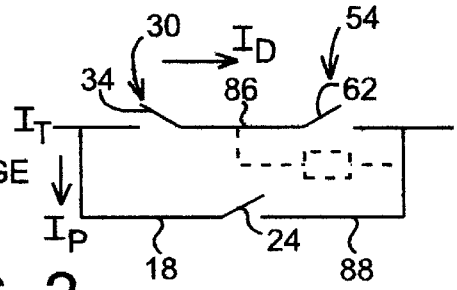
FIG. 2
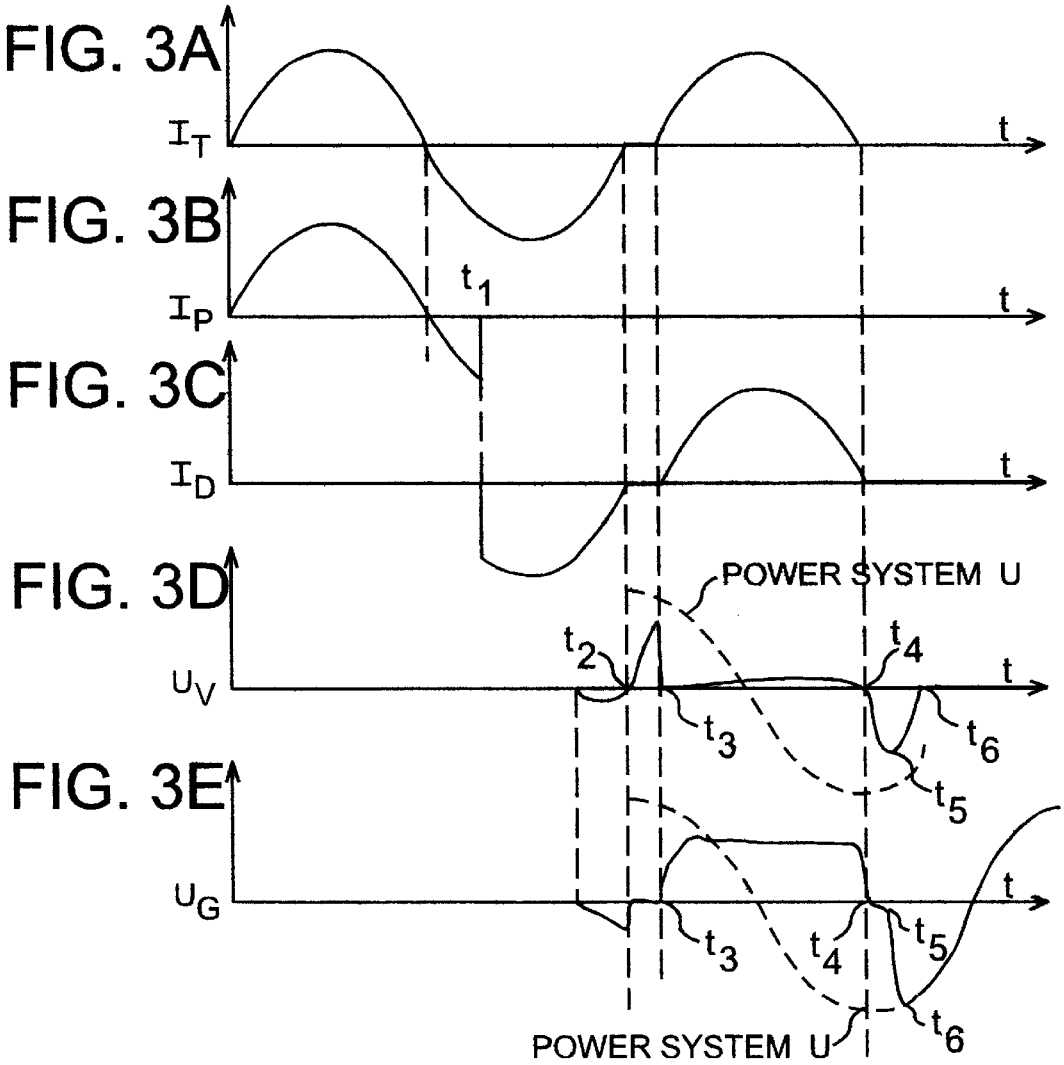

HIGH VOLTAGE HYBRID CIRCUIT-BREAKER

The invention relates to a high voltage hybrid circuit breaker comprising in each pole:

a primary circuit with primary contacts for flow of the rated current, an arcing circuit having a gas circuit breaker connected in series with a switch supporting the dU/dt of the transient recovery voltage, means for actuating the movable primary contact and the movable arcing contacts between open and closed positions, current input terminals, a housing filled with an insulating gas with high dielectric strength, said housing being subdivided into a first compartment enclosed by an insulator for housing the primary contacts of the primary circuit and the gas circuit breaker, and an adjacent second compartment housing the switch, said second compartment being formed by a metallic enclosure made of conducting material.

The breaking device according to the document DE-A-4, 405,206 relates to an SF6 gas switch contained in an insulating enclosure and connected in series with a vacuum switch, which is arranged in a metallic housing. Each switch has its own actuating means, those associated to the vacuum switch operating only when the short-circuit current exceeds a preset threshold. The vacuum switch is formed by several vacuum cartridges connected in parallel. The operating state of these cartridges cannot easily be checked by the user.

According to another known device, the gas circuit breaker and vacuum cartridge assembly is housed in a common enclosure, and two operating mechanisms are required to actuate the arcing contacts. Such a device is complicated and costly.

The object of the invention is to achieve a high voltage hybrid circuit breaker of simple and inexpensive design.

The circuit breaker according to the invention is characterized in that the movable arcing contact of the gas circuit breaker is actuated with the movable primary contact by a primary control rod connected to a common mechanism, the displacement movement of the movable arcing contact of the switch being derived from the translational movement of the primary rod through an intermediate transmission lever housed in the second compartment.

As the switch does not have to withstand the power system voltage, it can be inserted in a compartment not having an insulator. The operating means of the switch are housed in this compartment. The switch can be formed either by a vacuum cartridge, or by a rotating arc breaking device, or by a power semi-conductor circuit.

The gas circuit breaker can be of the self-extinguishing expansion or piston gas-blast type.

Other advantages and features will become more clearly apparent from the following description of an embodiment of the invention given as a non-restrictive example only and represented in accompanying drawings in which:

FIG. 2 shows the wiring diagram of the hybrid circuit breaker;

FIGS. 3A to 3E represent the diagrams of the current and voltage versus time.

Figure 1:
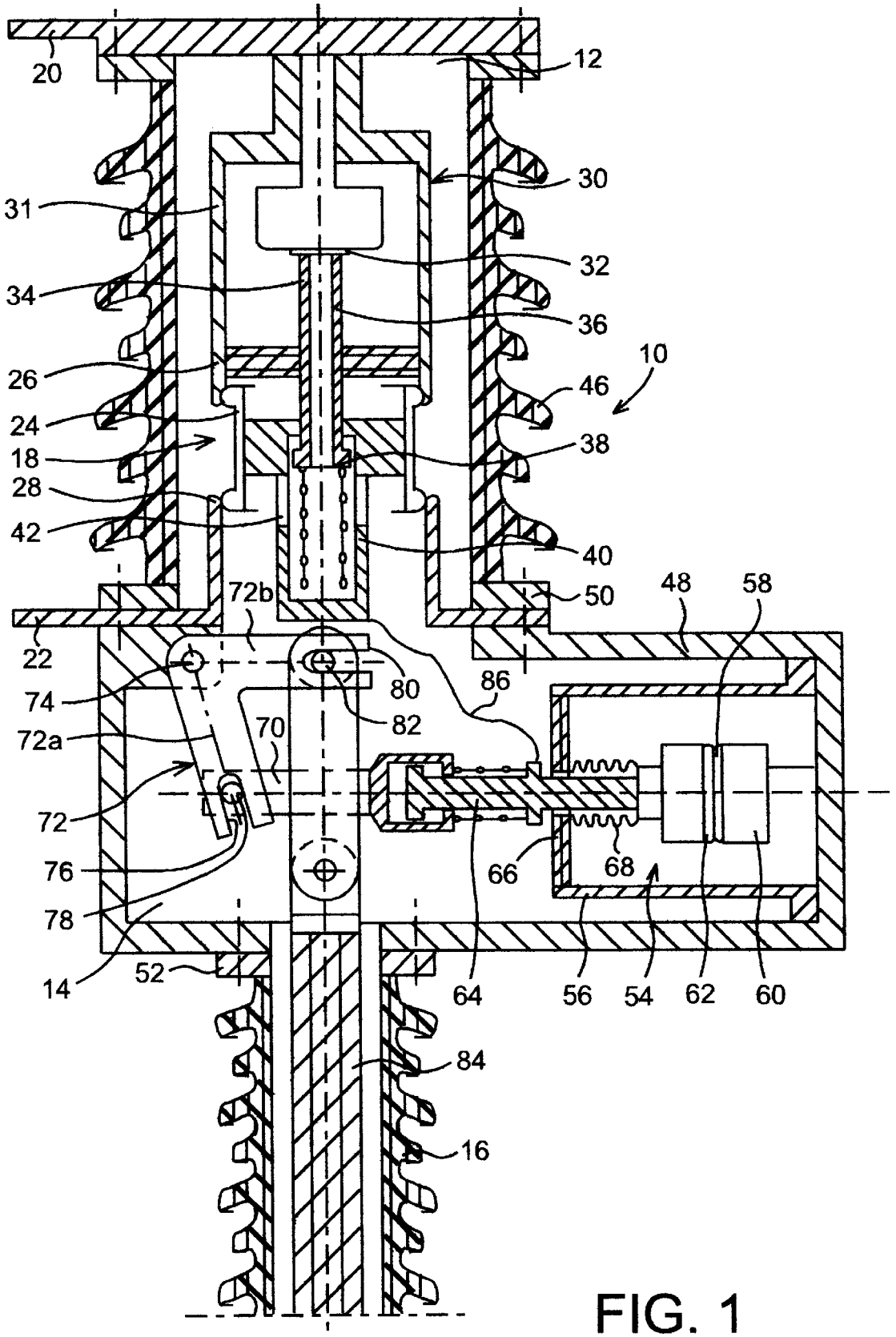
FIG. 1 is a schematic cross-sectional view of the hybrid circuit breaker according to the invention.

In FIG. 1, a pole of a high voltage, notably more than 100 kV, hybrid circuit breaker 10 comprises a system of multiple contacts housed in a first compartment 12 and an adjacent second compartment 14, the whole assembly being supported by a hollow supporting insulator 16.

The first compartment 12 houses a primary circuit 18 supplied by a pair of connection terminals 20, 22, and comprising a movable primary contact 24 in the form of a bridge cooperating with stationary primary contacts 26, 28 in electrical connection respectively with the terminals 20, 22. The primary circuit 18 coaxially surrounds a gas circuit breaker 30 comprising a first metallic chamber 31 housing a first stationary arcing contact 32, and a tubular second arcing contact 34 arranged at the end of a conducting tube 36. The other end of the tube 36 is equipped with a drive spur 38 cooperating with a transmission block 40 to move the movable second arcing contact 34 in translation between a closed position and an open position.

The inside of the chamber 31 communicates with the remaining volume of the first compartment 12 via the tube 36 and radial openings 42 of the block 40. A spring 44 fitted between the block 40 and the spur 38 of the tube 36 urges the second arcing contact 34 into engagement against the first arcing contact 32.

The first compartment 12 is bounded by an insulator 46 made of insulating material, notably ceramic, whereas the second compartment 14 is arranged in a tight enclosure 48 made of metallic conducting material, arranged between the open end 50 of the insulator 46 and an end-piece 52 of the supporting insulator 16. The two compartments 12, 14 are filled with an insulating gas with high dielectric strength, notably sulphur hexafluoride.

A vacuum cartridge 54 is arranged inside the second compartment 14 and comprises a tight second chamber 56 being in depression with respect to the gas pressure. The vacuum cartridge 54 houses a stationary third arcing contact 58 borne by a stud 60 secured to the metallic enclosure 48, and a movable fourth arcing contact 62 actuated in translation by a control rod 64 between a closed position and an open position. The sliding rod 64 passes through the insulating front wall 66 of the chamber 56 with interposition of a sealing bellows 68 and is furthermore in mechanical connection with a connecting rod 70 cooperating with a double drive lever 72.

The double lever 72 is mounted with limited pivoting on a spindle 74 and comprises a first arm 72*a* having an oblong first opening 76 in which a crank 78 of the connecting system moves. The second arm 72*b* is provided with an oblong second opening 80 in which a drive spindle 82 securedly affixed to the primary control rod 84 is engaged. The pivoting spindle 74 of the double lever 72 is secured to the metallic enclosure 48 and the straight connecting rod 70 extends perpendicularly to the primary rod 84 of the circuit breaker 10, which is connected to the operating mechanism (not represented) by passing through the hollow supporting insulator 16.

The control rod 64 of the vacuum cartridge 54 is an electrical conductor and is electrically connected to the block 40 by a braided connecting strip 86. The block 40 is electrically connected to the contact 34 by a sliding contact, for example grips (not represented).

The enclosure 48 is electrically connected to the stationary primary contact 28 in connection with the terminal 22.

FIG. 2 shows the single-pole wiring diagram of the hybrid circuit breaker 10. The primary circuit 18 in which the rated current IP flows is electrically connected in parallel to the terminals of the gas circuit breaker 30 and of the vacuum cartridge 54, whose movable arcing contacts 34, 62 are connected in series by the braided connecting strip 86.

A voltage dependent resistor 88 represented in a broken line in FIG. 2 can be connected to the terminals of the vacuum cartridge 54.

Operation of the hybrid circuit breaker 10 according to the invention is as follows:

In the closed position of the circuit breaker 10, represented in FIG. 1, the primary contacts 24, 26, 28, and all the arcing contacts 32, 34; 58, 62 are closed. Most of the current flows through the primary circuit 18, and the form of the total current IT is illustrated in FIG. 3A.

When a fault current occurs, the mechanism actuates the primary rod 84 downwards, causing at the time t1 opening of the primary contacts and switching of the current into the parallel arcing circuit. FIG. 3B shows interruption of the primary current IP at the time t1 and FIG. 3C shows the appearance of the current ID in the arcing circuit.

After it has taken up its dead travel, the transmission block 40 drives the spur 38 of the tube 36, and the downwards motion of the spindle 82 at the same time causes clockwise pivoting of the double lever 72 and translation of the connecting rod 70 to the left. This results in almost simultaneous opening of the two pairs of arcing contacts 32, 34; 58, 62 of the gas circuit breaker 30 and of the vacuum cartridge 54.

In FIGS. 3D and 3E respectively representing the arcing voltages at the terminals of the vacuum cartridge 54 and of the gas circuit breaker 30, it can be observed that the vacuum cartridge 54 supports the transient recovery voltage between the times t2 and t3. In the example represented, the gas circuit breaker 30 has not yet deionised at the time t3. As the vacuum cartridge 54 cannot withstand the power system voltage, it reflashes at the time t3. We then wait until the next time the current reaches zero, which takes place at the time t4. As before, the vacuum cartridge withstands the transient recovery voltage between the times t4 and t5. This time, the gas circuit breaker 30 is in a condition to deionise. This is what it does from t5. The voltage then progressively shifts onto it, between t5 and t6. From t6, it withstands the power system voltage on its own.

The dielectric strength of the hybrid circuit breaker 10 is provided by the gas circuit breaker 30, which absolutely must be placed in the first compartment 12 of the insulator 46.

The vacuum cartridge 54 is unable to withstand the power system voltage and can therefore be placed in the second compartment 14 of the metallic enclosure 48. The double lever 72 and the control rod 70 of the vacuum cartridge 54 are also placed in the second compartment 14. It is clear that the vacuum cartridge can be replaced by another switch that can easily withstand the dU/dt of the transient recovery voltage, for example a rotating arc switch or a power semi-conductor.

The gas circuit breaker may be a self-extinguishing expansion or piston gas-blast circuit breaker able to withstand high voltages, for example in excess of 100 kV.

According to an alternative embodiment the rods 84 and 70 can extend in any direction.

We claim:

1. A high voltage hybrid circuit breaker comprising:

a primary circuit through which a rated current flows, said primary circuit comprising a stationary primary contact and a movable primary contact;

current input terminals electrically connected to said primary circuit;

an arcing circuit electrically connected in parallel with said primary circuit, said arcing circuit comprising a gas circuit breaker and a switch, said gas circuit breaker comprising: a first stationary arcing contact and a second movable arcing contact, and said switch comprising: a vacuum cartridge, a third stationary arcing contact, and a fourth movable arcing contact, said switch electrically connected in series with said gas circuit breaker;

a housing filled with an insulating gas of high-dielectric strength, said housing being subdivided into a first compartment having an insulator enclosing said first compartment, and a second compartment adjacent to said first compartment and having a conductive metallic enclosure; said primary contact of said primary circuit and said gas circuit breaker of said arcing circuit being housed within said first compartment of said housing, and said vacuum cartridge is housed within said second compartment of said housing;

means for actuating said movable primary contact of said primary circuit, said second movable arcing contact of said gas circuit breaker, and said fourth movable arcing contact of said switch between open positions and a closed positions, wherein said means for actuating comprising a main rod for actuating said primary contact of said primary circuit and said second movable arcing contact of said gas circuit breaker, and an intermediate transmission lever housed in said second compartment and mechanically coupled to both said main rod and said fourth movable arcing contact of said switch so that movement of said main rod moves said fourth movable arcing contact of said switch via movement of said intermediate transmission lever;

whereby said vacuum cartridge of said switch supports a transient recovery voltage, and said gas circuit breaker provides dielectric strength for the hybrid circuit breaker.

2. A high voltage hybrid circuit breaker according to claim 1, wherein said gas circuit breaker comprises a gas expansion, arc extinguishing chamber.

3. A high voltage hybrid circuit breaker according to claim 1, wherein said gas circuit breaker comprises a gas puffer chamber.

* * * * *